US005836592A

United States Patent [19]

Chang

[11] Patent Number: 5,836,592

[45] Date of Patent: Nov. 17, 1998

[54] STRUCTURE FOR IN-LINE ROLLER SKATES

[76] Inventor: Sheng-Hsiung Chang, No.510, Sec.5, Chung-Shin Road, San-Chung, Taipei, Taiwan

[21] Appl. No.: 784,993

[22] Filed: Jan. 17, 1997

[51] Int. Cl.[6] ..... A63C 1/22; A63C 1/26

[52] U.S. Cl. ..... 280/11.26; 280/11.3

[58] Field of Search ..... 280/11.26, 11.3, 280/11.12, 11.19, 11.16, 11.22, 11.23, 11.32, 7.13

[56] References Cited

U.S. PATENT DOCUMENTS

| | | | |
|---|---|---|---|
| 3,202,434 | 8/1965 | Goodman | 280/11.26 |
| 3,993,318 | 11/1976 | Rothmayer | 280/11.26 |
| 4,932,675 | 6/1990 | Olson et al. | 280/7.13 |
| 5,498,009 | 3/1996 | Young | 280/11.12 |
| 5,645,288 | 7/1997 | Lu | 280/11.26 |
| 5,741,018 | 4/1998 | Huang | 280/11.3 |

*Primary Examiner*—Brian L. Johnson
*Assistant Examiner*—Bridget Avery
*Attorney, Agent, or Firm*—Bacon & Thomas

[57] ABSTRACT

An improved structure of an in-line roller skate, in which a wheel seat and a skate quarter are integrally formed, the front end of the wheel seat has a receiving seat having a slide groove which has thereon a screw hole and is for engaging therein a guide plate on the bottom of a skate toe placed on the receiving seat, the guide plate has an elongated slot engraved on both sides with marks spaced by a suitable distance and is press lapped with the positioning sheet having two viewing holes behind a screw hole being extended therethrough with a screw which is further screwed through the slot on the guide plate and then into the screw hole in the slide groove of the receiving seat, so that the skate toe can be slided and micro-adjusted in the slide groove, such structure suits feet of youths enlarged during growth of youths.

1 Claim, 5 Drawing Sheets

STRUCTURE FOR IN-LINE ROLLER SKATES

BACKGROUND OF THE INVENTION

1. Field of the Invention

The present invention relates to an improved structure of an in-line roller skate, and especially to an in-line roller skate of which the front end of the quarter of the skate can be micro-adjusted without sectioning suitable for growing youths with their feet varying, the extension of size of the in-line roller skate can thereby increased, this can avoid waste due to the requirement of changing the whole pair of in-line roller skates with a new set because of growing of the feet, and can increase effect of utilization of the in-line roller skate, thus is economic and practical.

2. Description of the Prior Art

Skating have always been one of the most delighted activities of youths, with a skate on feet, a youth can enjoy the fun of flying in the wind, yet he can get healthiness thereby, it is really an excellent activity for leisure; the supreme utensil for skating is a pair of skates, fun of skating can only be taken when the skates are fitted to the feet, if the skates are too large or too small, the feet will feel uncomfortable, to use the skates too small reluctantly, the feet may blister and danger may be induced, while to use the skates too large, the skates are loosely put on, the skater may unstably moved in skating, and can hardly push forwards by one foot pushing while the other sliding; so that fun of skating can only be taken when the skates are fitted to the feet, feet of youths are growing together with growth of youths themselves, a pair of skates of them may be too small to be worn on, buying a new pair will still encounter the same problem after a certain period, and waste will exist, and thus is uneconomic; in this view, some people give up exercising of skating when the skates are no longer able of being worn on, and a healthy leisure activity thus disapears for them; sizes of the skates are fixed, the conventional skates can not afford long time utilization for youths.

The four wheel skates in the earlier time can be done a small adjustment on the frames between the front and the rear wheels, supporting strength of the frame between the wheels is relatively reduced when the distance between the wheels is increased, and this can damage the structural strength of the wheel seat and is relatively dangerous to a user; the in-line roller skates prevailing now are partially adjustable on the wheel seats thereof to increase the sizes of the wheel seats, however, the front and the rear wheels of a in-line roller skate are all requested to be aligned in one line, the distance between the front wheels and the rear wheels is increased when in adjusting, this will not only damage structural strength of the wheel seats, the wheel seats can also bear larger torsion force when in turning of the skaters due to increment of such distance, thereby, the four wheels will not in alignment in a straight line. When in skating, unfirmness of the structure of a wheel seat renders the wheels unaligned and thereby unstable in standing thereon, there is hardly a chance for accelerating to speed in skating, in this case, the skates are subjected to breaking, and thus is highly dangerous; skates are the main supporting utensil for a user, they must bear the weight of the user, adjustment of the skates influences directly safety of the user, undue adjustment can damage the structural strength of the skates and will be unable to support, this needs payment of caution.

SUMMARY OF THE INVENTION

In view of the aforesaid disadvantage, and in view that the exercise of skating is an excellent activity for leisure and worthy of promotion, due to the reason that skates can not afford long time utilization for youths, a user may give up exercising of skating when the skates are no longer able of being worn on, the inventor of the prensent invention finally provides the improved structure of the invention after continuous study, improving, designing, development as-well as repeat experiments, examination and trials based on his experience of years in producing, designing similar products, wherein the wheel seat and the quarter of a skate are formed integrally, the skate can be micro-adjusted on the front end of the quarter to adjust size of the quarter.

During the stage of the experimental procedures, the inventor tried to provide adjustment by mating of a dove tail groove and its seat (referring to FIG. 1 attached hereinafter), wherein, the dove tail shaped seat B is provided on the front end of the quarter A of a skate, the dove tail groove D is provided beneath the skate toe C, by means of the mating dove tail groove D of the skate toe C and the dove tail seat B of the quarter A, the skate toe C can be slidably adjusted on the quarter A; however, after testing of the inventor, the design of mating of the dove tail groove D and the dove tail seat B is not in conformity to the shape of the skate quarter A, i.e., the dove tail groove D and the dove tail seat B must be horizontally matingly connected with each other, if the quarter A and the skate toe C are deviated, they can not be mated, and when in mating of the dove tail groove D with the dove tail seat B, the quarter A and the skate toe C will be subjected to violent vibration during moving, thus do not work well for skates practically; in view of this, the inventor insists in improving and restarts to study and develop and finally provides the present invention.

The main object of the prensent invention is that: to form integrally the wheel seat and the quarter of a skate, the skate toe is movably connected thereon, so that the skate toe can be micro-adjusted to increase size of the quarter without damaging the structural strength of the wheel seat or the skate quarter, and thus can be adapted to variation of feet of youths in their growth.

Another object of the prensent invention is that: the joint between the wheel seat and the skate quarter is surrounded with a woven belt to cover the gap created during adjustment between the skate toe and the shoe quarter, and further to firmly fix a shoe to the quarter.

The present invention will be apparent in its practical structure and mode of utilization after reading the detailed description of the preferred embodiment thereof in reference to the accompanying drawings.

DETAILED DESCRIPTION OF THE PREFERRED EMBODIMENT

Figure 1:
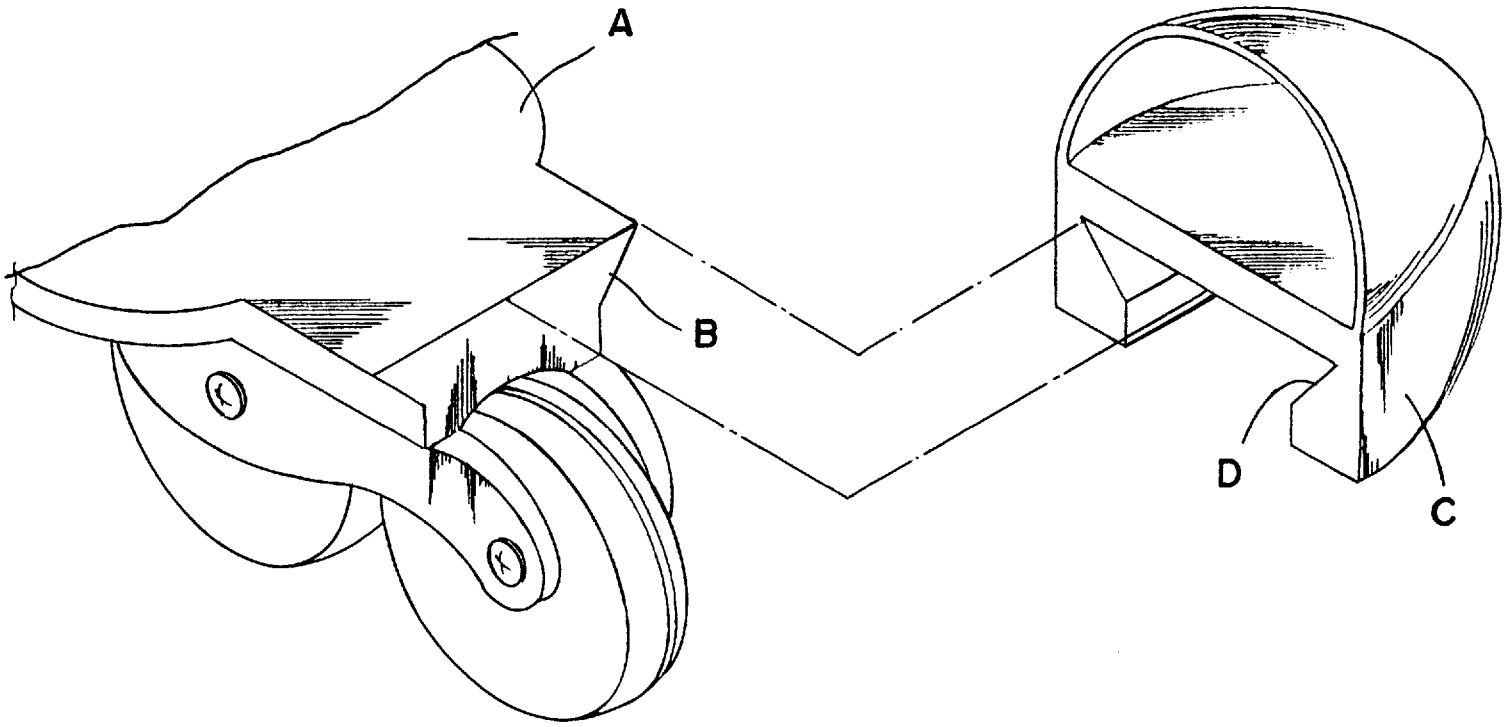
FIG. 1 is a schematic view of a roller skate made by the inventor during the stage of experiment.
Figure 2:
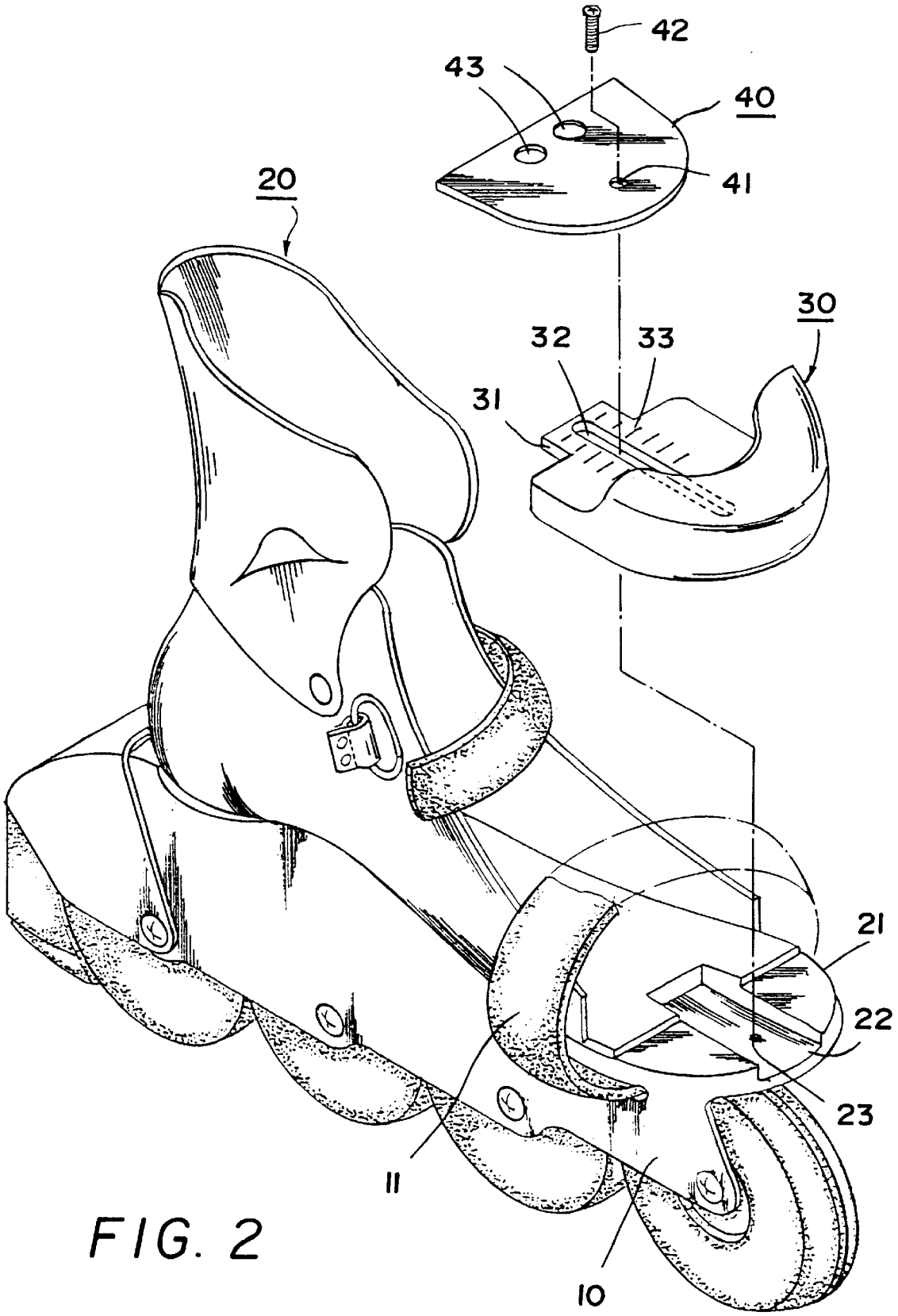
FIG. 2 is an analytical schematic view of the structure of the present invention.

Referring to FIG. 2, the present invention is comprised of the members of a wheel seat 10, a skate quarter 20, a skate toe 30 and a positioning sheet 40 etc., wherein:

the wheel seat 10 and the skate quarter 20 are integrally formed, the front end of the wheel seat 10 is provided on a lateral side thereof with a woven belt 11, while a receiving seat 21 is provided on the front end of the skate quarter 20, the receiving seat 21 is provided with a slide groove 22 which is provided at an appropriate location thereon with a screw hole 23;

the skate toe 30 is an arciform hood, a guide plate 31 is provided on the bottom thereof, the guide plate 31 is provided with an elongated slot 32 which is engraved on the rear portion thereof with marks 33 spaced by a suitable distance, the marks 33 are indicated with numbers of sizes in the U.S. system as well as in the British system respectively on the two sides of the elongated slot 32;

the positioning sheet 40 is in a form of semi-round and is provided with a screw hole 41 which is to be extended therethrough with a screw 42, the positioning sheet 40 is provided with two round viewing holes 43 behind the screw hole 41.

Figure 3:
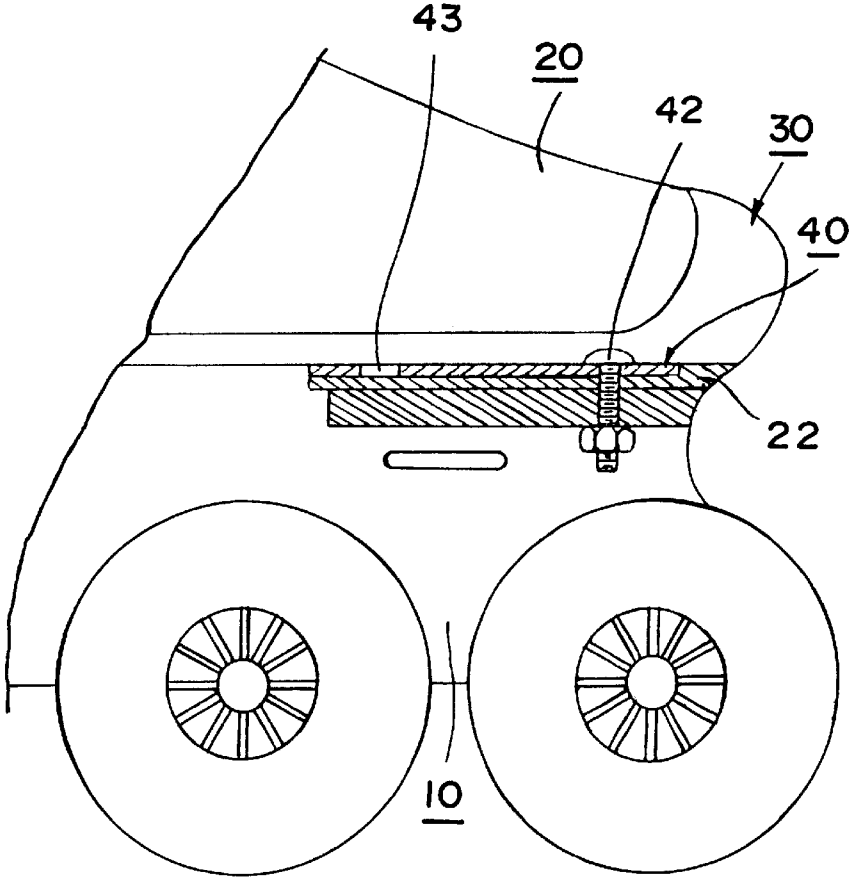
FIG. 3 is a schematic sectional view of the structure of the present invention.

By means of the above stated members, the skate toe 30 is placed on the receiving seat 21 of the skate quarter 20, while the guide plate 31 on the bottom of the skate toe 30 is engaged in the slide groove 22 of the receiving seat 21, then the positioning sheet 40 is press lapped on the inner surface of the skate toe 30, the screw 42 is extended through the screw hole 41 on the positioning sheet 40 and the elongated slot 32 on the skate toe 30, and is screwed into the screw hole 23 in the slide groove 22 of the receiving seat 21, so that the skate toe 30 and the positioning sheet 40 are locked on the receiving seat 21 of the skate quarter 20 (referring to FIG. 3 attached), the two viewing holes 43 on the positioning sheet 40 are aligned with the marks 33 on the guide plate 31 of the skate toe 30, which marks 33 are indicated with numbers of sizes in the U.S. system as well as in the British system respectively, a user can find the required mark 33 conveniently.

Figure 4:
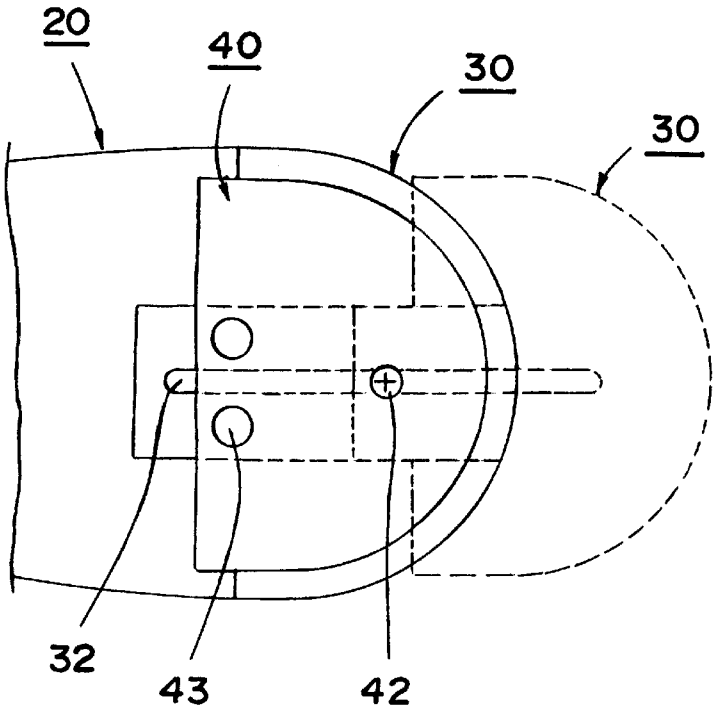
FIG. 4 is a schematic view of the present invention showing the mode of moving of the skate toe.
Figure 5:
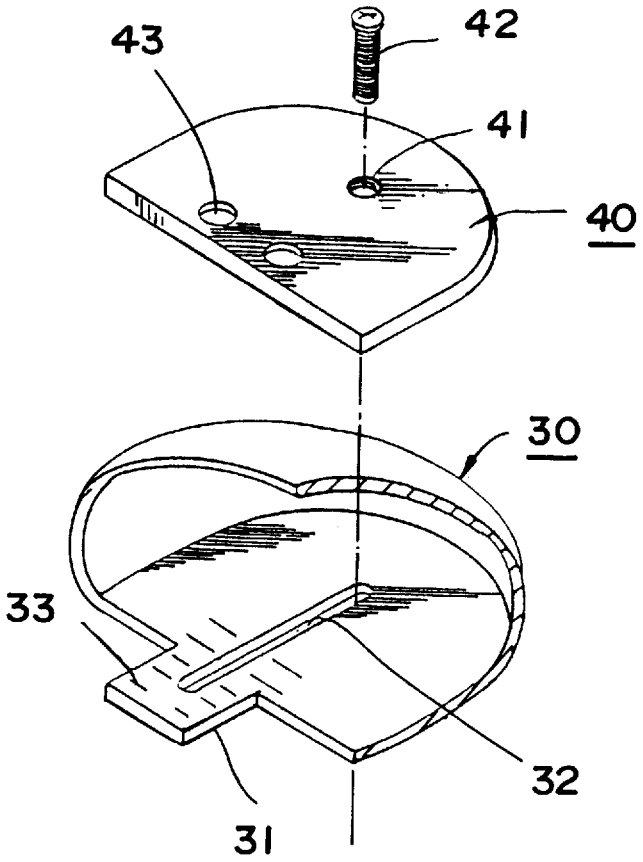
FIG. 5 is a schematic sectional view of the present invention showing covering of a binding belt on the skate toe.
Figure 6:
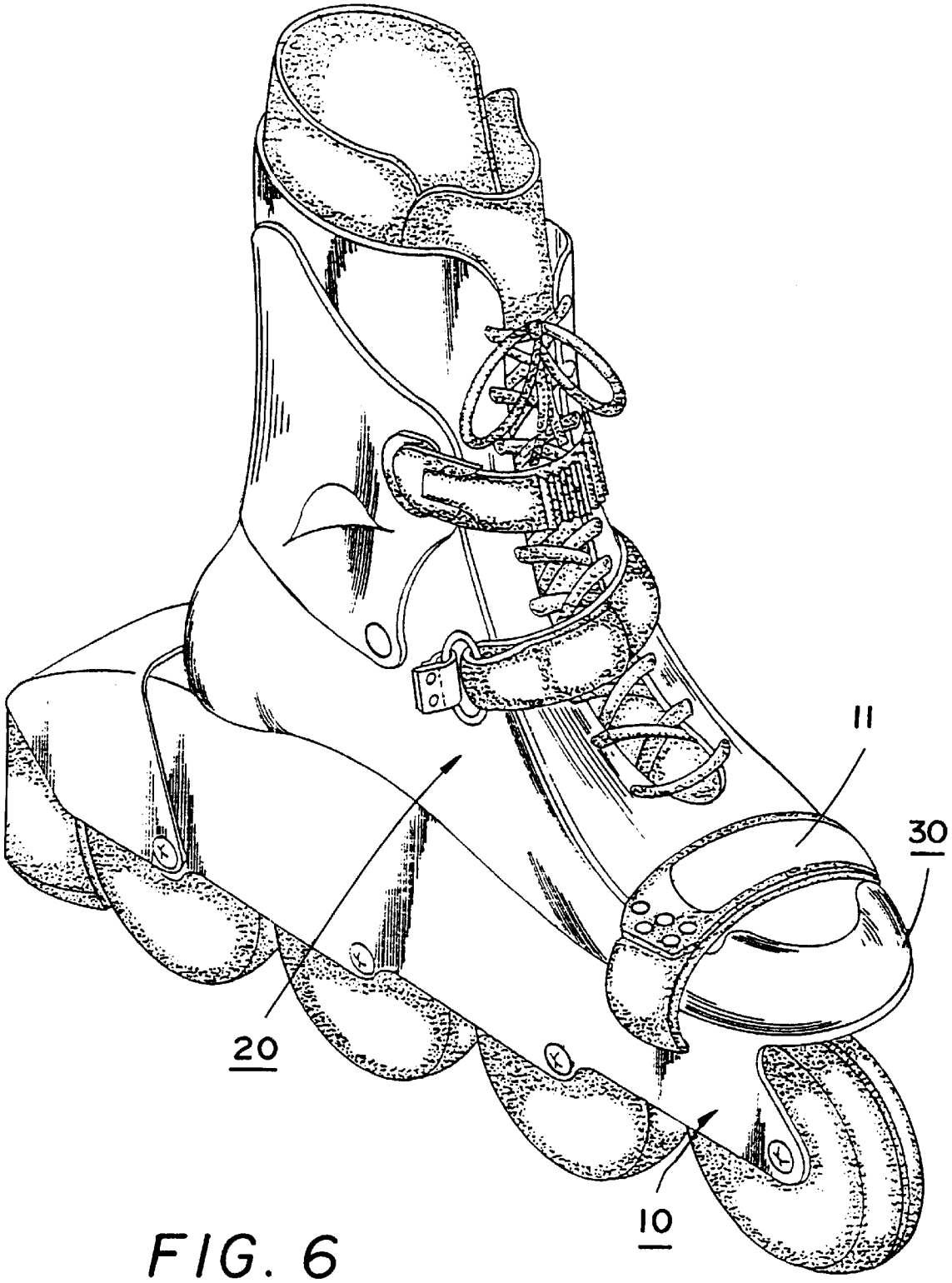

Referring to FIG. 4 and 5 of the attached drawings, when the skate toe 30 is to be adjusted, the screw 42 on the positioning sheet 40 is loosened firstly, move the skate toe 30 outwardly, view from the viewing holes 43 to find a suitable size mark 33, then screw tight the screw 42 again, adjustment is completed; after adjustment, a gap will be induced between the skate quarter 20 and the skate toe 30, the gap can be covered with the woven belt 11 surrounding the skate quarter 20 and the skate toe 30 and provided on a lateral side of the front end of the wheel seat 10, the woven belt 11 can also tightly tie the skate toe 30 on the skate quarter 20, and further firmly fix a shoe 50 to the quarter 20. (referring to FIG. 6 attached).

Having thus described the technical structure of my invention with practicability and improveness, therefore, what I claim as new and desire to be secured by Letters Patent of the United States is:

1. An improved structure of an in-line roller skate, comprised of members of a wheel seat, a skate quarter, a skate toe and a positioning sheet, wherein:

said wheel seat and said skate quarter are integrally formed, a front end of said wheel seat is provided on lateral sides thereof with a woven belt, while a receiving seat is provided on the front end of said skate quarter, said receiving seat is provided with a slide groove which is provided at an appropriate location thereon with a screw hole;

said skate toe is an arciform hood, a guide plate is provided on a rear bottom thereof, said guide plate is provided with an elongated slot which is engraved on a rear portion thereof with marks spaced by a suitable distance, said marks are indicated with numbers of sizes in the U.S. system as well as in the British system, respectively on the two sides of said elongated slot;

said positioning sheet is semi-round and is provided with a screw hole with a screw which extends therethrough said positioning sheet is provided with two round viewing holes behind said screw hole;

said skate toe is placed on said receiving seat of said skate quarter while said guide plate on a bottom of said skate toe is engaged in said slide groove of said seat, said positioning sheet is press lapped on an inner surface of said skate toe, said screw extends through said screw hole-on said positioning sheet and said elongated slot of said skate toe, and is screwed into said screw hole in said slide groove of said seat, so that said skate toe and positioning sheet are locked on said skate quarter, said two viewing holes on said positioning sheet are aligned with said marks on said guide plate; when said skate toe is adjusted, as said screw on said positioning sheet is first loosened said skate toe moves outwardly, and is viewable through viewing holes to find a suitable size mark, then upon tightening said screw again, micro-adjustment is completed; the woven belt on a lateral side of the front end of said wheel seat covers a gap induced between said skate quarter and said skate toe.

* * * * *